United States Patent [19]

Rodriguez

[11] Patent Number: 4,610,114

[45] Date of Patent: Sep. 9, 1986

[54] METAL FRAME HOMES

[76] Inventor: Don R. Rodriguez, 14922 Royal Birkdale, Houston, Tex. 77048

[21] Appl. No.: 586,432

[22] Filed: Mar. 5, 1984

[51] Int. Cl.[4] ..... E04B 7/02; E04B 7/12

[52] U.S. Cl. ..... 52/93; 52/90; 52/94; 52/648

[58] Field of Search ..... 52/18, 13, 14, 90–94, 52/648

[56] References Cited

U.S. PATENT DOCUMENTS

| | | | |
|---|---|---|---|
| 3,964,218 | 6/1976 | Ho | 52/90 |
| 4,179,857 | 12/1979 | Danford | 52/71 |
| 4,192,108 | 3/1980 | Lowe | 52/90 |
| 4,347,691 | 9/1982 | Lloyd-Jones | 52/95 |
| 4,357,782 | 11/1982 | Peter | 52/18 |
| 4,364,212 | 12/1982 | Pearson et al. | 52/281 |
| 4,365,453 | 12/1982 | Lowe | 52/478 |
| 4,376,362 | 3/1983 | Jackson | 52/639 |
| 4,389,829 | 6/1983 | Murphy | 52/693 |
| 4,391,061 | 7/1983 | Vermillion | 52/264 |
| 4,397,127 | 8/1983 | Strongsville | 52/241 |

FOREIGN PATENT DOCUMENTS

| | | | |
|---|---|---|---|
| 714247 | 7/1965 | Canada | 52/93 |

OTHER PUBLICATIONS

*American Builder,* Sep. 1945, p. 113.

*American Builder,* vol. 74, issue 12, pp. 118–123, Dec. 1952.

*Primary Examiner*—Alfred C. Perham

*Attorney, Agent, or Firm*—Pravel, Gambrell, Hewitt & Kimball

[57] ABSTRACT

A metal frame construction for residences having gabled or hipped roofs which is readily adaptable to form any of the typical gable or hip roof variations used in residential plans designed to be built using wooden framing. The frame construction includes a primary rigid frame and one or more secondary ridge beam/-column frames joined to the primary rigid frame to form a new and different framing system for any of the typical residential gabled or hip roof plans.

12 Claims, 18 Drawing Figures

METAL FRAME HOMES

BACKGROUND OF THE INVENTION

1. Field of Invention

The present invention relates to a metal frame construction for homes or other buildings of the type having gabled or hip roofs.

2. Description of the Prior Art

Frames for buildings or residences have been constructed using steel or other metalized structural members. In the past, steel structural members for framing were most commonly used in the construction of commercial buildings, and the use of metalized construction in residential construction was minimal.

While other reasons may have existed for not using metal structural members in homes, one primary reason was that existing steel structural members or systems were not readily adaptable for use with typical residential architectural plans. For example, it is very common for residential plans to include gabled or hip roofs having one or more secondary gables or hips extending at right angles to the primary structures. Conventional framing arrangements for preengineered steel buildings which are generally rectangular in shape where not suitable for the numerous variations in floor plans and architectural styles required for residential structures. The modular system of the present invention incorporates desired clear span, non-load bearing wall features of steel frame construction while maintaining the gabled or hip roof architectural features of wood frame construction. The system permits the use of light gauge, non-load bearing metal studs for exterior and interior walls.

SUMMARY OF THE INVENTION

Briefly, the present invention provides a new and improved metal frame construction for residences having gabled or hipped roofs which is readily adaptable to form any of the typical gable or hip roof variations used in residential plans designed to be built using wooden framing. The present invention thereby provides the builder with a new and different system for framing homes with preformed steel framing members having the advantages of structural simplicity, strength and fire resistance. Apart from the structural advantages, significant cost savings may be possible for the owner of a residence constructed in accordance with the frame of the present invention through the reduction of fire hazard insurance and wind damage premiums on the residence. These savings in many instances may substantially offset the increased expense of using steel framing members.

The frame construction of the present invention includes a primary rigid frame and one or more secondary ridge beam/column frames joined to the primary rigid frame to form a new and different framing system for any of the typical residential gabled or hip roof plans.

The present invention also includes additional primary and secondary steel framing and metal decking so arranged and fabricated to provide a complete framing system ready for application of conventional finish materials on the roof and walls.

DESCRIPTION OF THE PREFERRED EMBODIMENT

Figure 1:
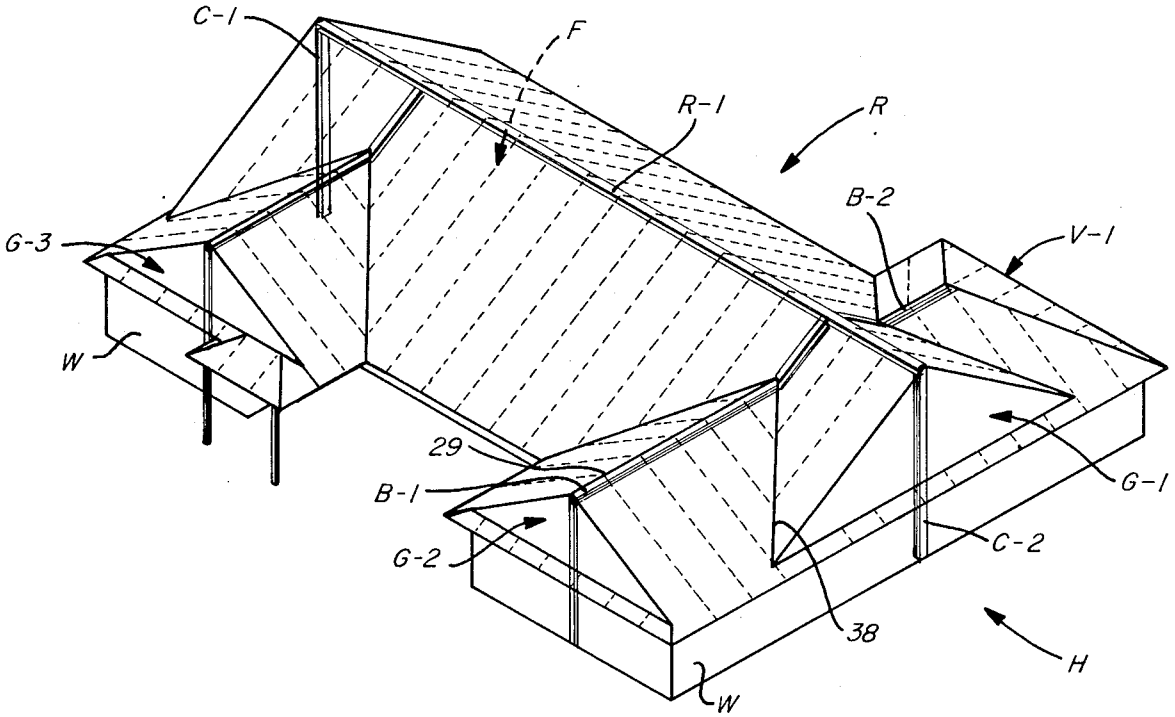
FIG. 1 is an isometric view of a residence constructed according to the present invention.

In the drawings, the letter H designates generally a metal frame residence having a gabled roof R (FIG. 1). Roof R typically includes a primary gable G-1 and one or more secondary gables G-2 and G-3, and a hip V-1. Residence H includes a metal frame F which forms a ridge support for roof R. It should be understood that while only a few specific embodiments are illustrated in the drawings, the frame F of the present invention may be readily adapted to provide support for a residence H which includes a roof R having one or more primary gables G-1 and any number of secondary gables G-2 or hips V-1 extending perpendicularly from the primary frame F.

Figure 3:
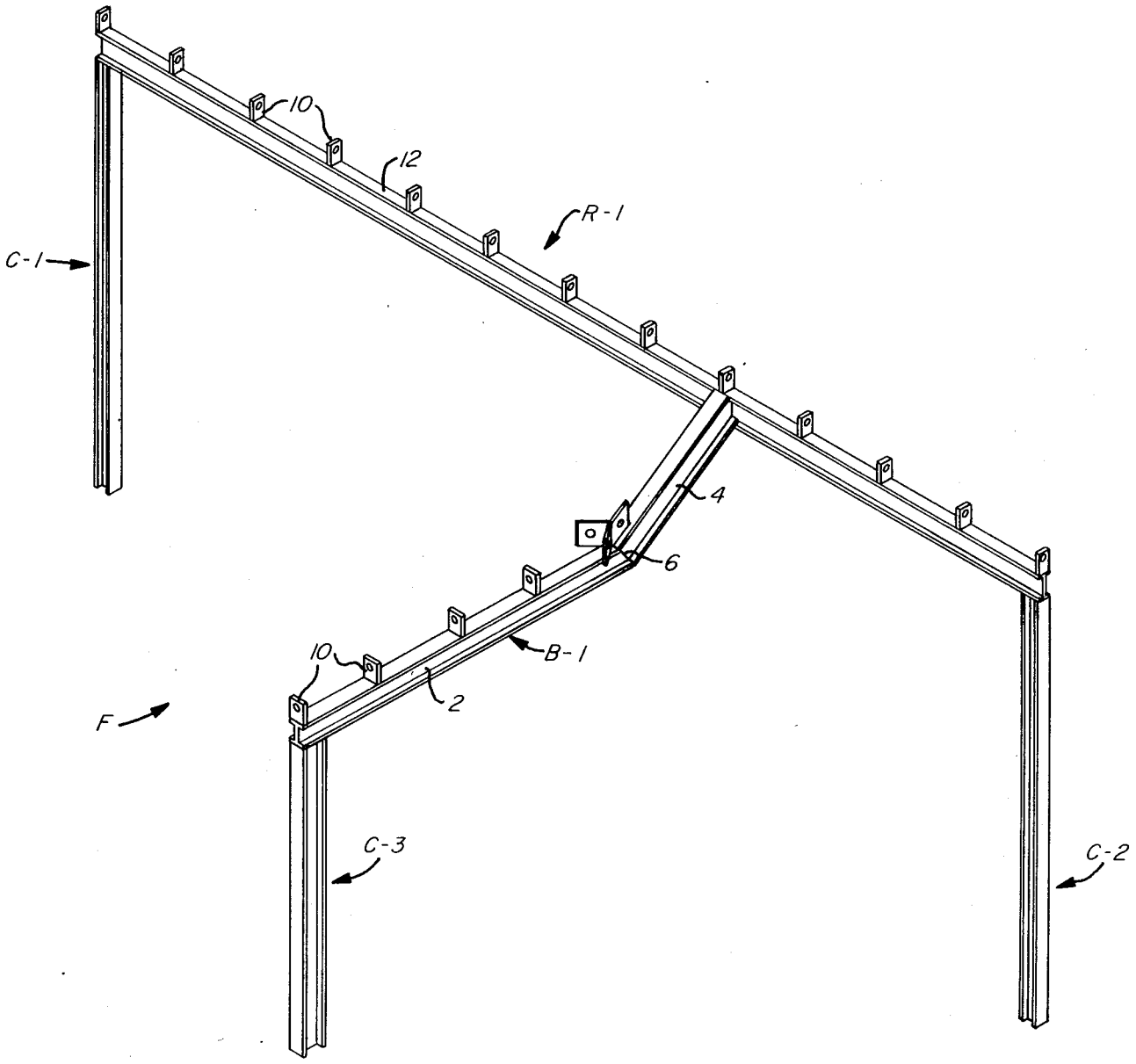
FIG. 3 is isometric view of a portion of a steel frame for a residence constructed according to the present invention.
Figure 4:
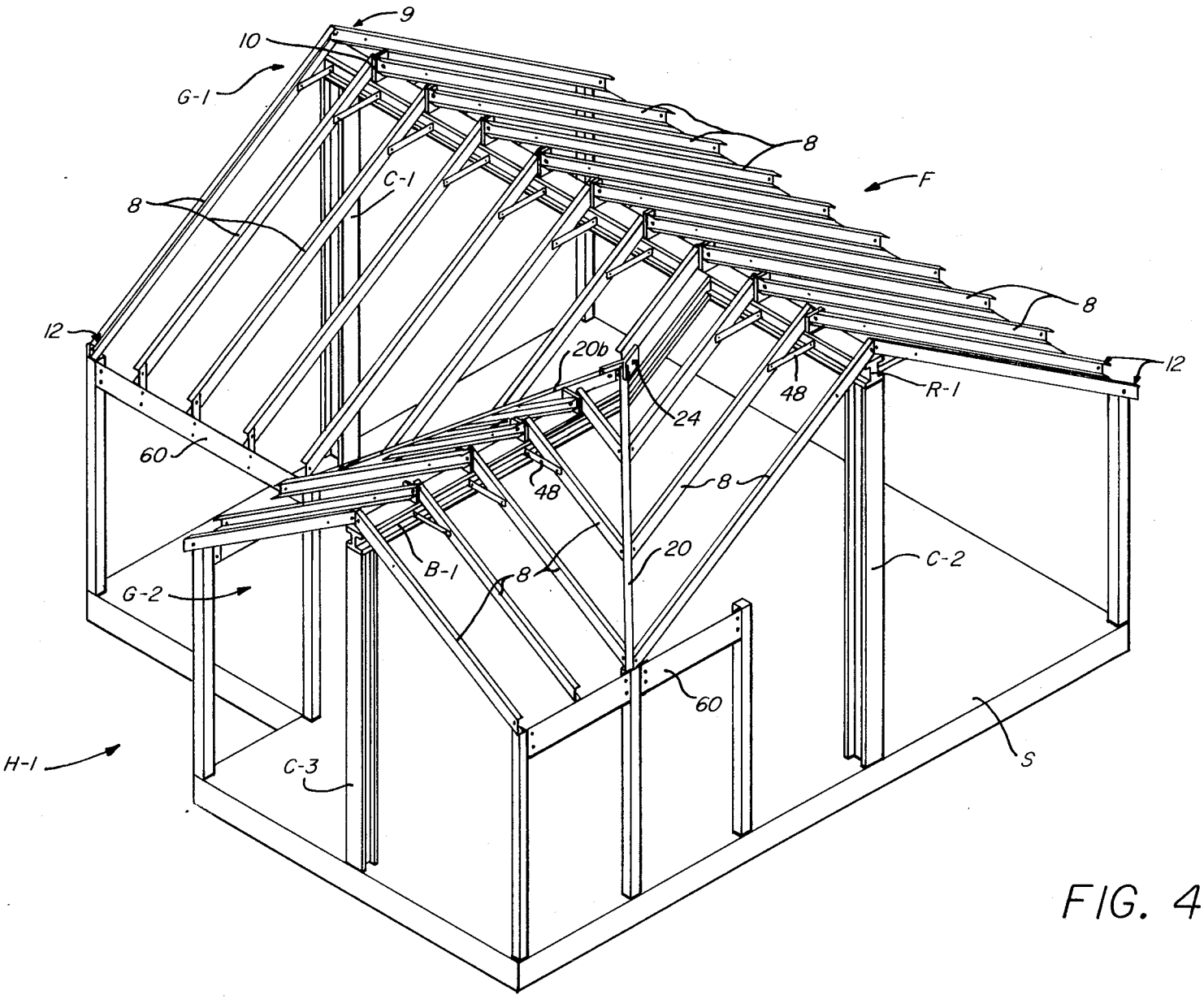
FIG. 4 is an isometric view of a portion of a steel frame for a residence constructed in accordance with the present invention.

Referring now to FIG. 3, a portion of a metal structural frame F suitable for supporting a roof R having a primary gable G-1 and a single, secondary gable G-2 is illustrated. Details of such a frame F are illustrated in FIG. 4. Frame F is a primary rigid frame which includes primary ridge beam or rafter R-1 and columns C-1 and C-2. Frame F also includes a secondary ridge beam B-1 and a third vertical column C-3.

Secondary ridge beam B-1 is formed having a horizontal section (2) and a sloping section 4 (FIG. 3). In the preferred embodiment, ridge supporting section 2 and sloping section 4 are welded at junction 6 to form an unitary load-bearing structural member. Secondary ridge beam B-1 is supported on one end by column C-3 and at the other end by a support connection to rafter R-1. Ridge beam B-1 is connected to rafter R-1 by bolting or other suitable structurally sound conventional method. In this fashion, frame F is formed without the need for additional vertical support members for ridge beam B-1 such as might otherwise be required to support ridge beam B-1 below junction 6. This feature of the present invention provides greater versatility and efficiency in utilizing interior floor space.

The elements of frame F, including rafter R-1, ridge beam B-1 and columns C-1, C-2 and C-3 are preferably formed of conventional structural steel shapes or welded plates for strength. The elements of frame F may be joined using any suitable conventional structural method such as welding, or providing suitable mounting flanges and structural machine bolts. The specific manner of attachment does not form a part of the present invention and hence is not illustrated.

The frame F illustrated in FIG. 3 forms the basic framework for the L-shaped residence H-1 illustrated in FIG. 4. Residence H-1 is supported upon a concrete slab S or other suitable foundation providing a substantially planar horizontal support surface.

Referring now to FIG. 4, vertical columns C-1, C-2 and C-3 are mounted to slab S in a suitable conventional manner such as by providing metal base plates welded to the column base and connected to slab S with conventional anchor bolts. The manner of attachment of structural columns such as C-1, C-2 and C-3 is well known in the art and hence is not illustrated in detail.

Figure 11:
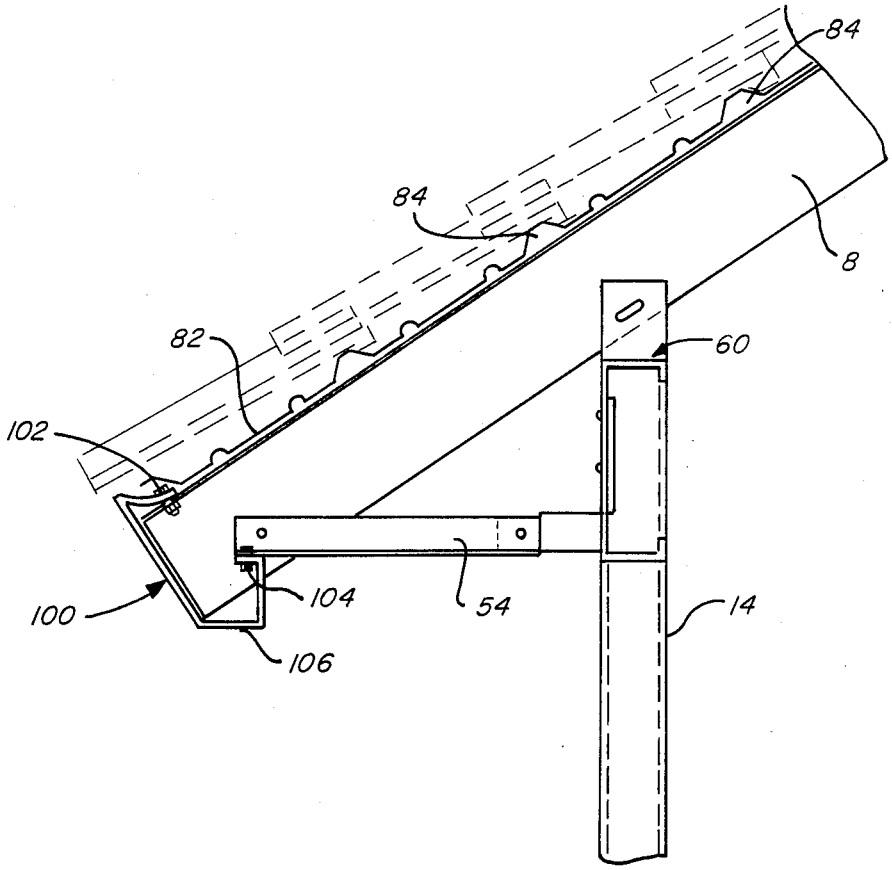

Frame F also includes a number of secondary rafters 8 which are formed from light gauge cold formed steel channels. Rafters 8 are mounted at upper end 9 to primary rafter R-1 and beam B-1 descend therefrom at the desired roof pitch. Secondary rafters 8 are mounted to uniformly spaced, vertically oriented planar mounting flanges 10 (FIG. 3) which are integral with the upper surface 12 of rafter R-1 and beam B-1. In the preferred embodiment, rafters 8 are mounted to flanges 10 using a conventional machine bolt connection through a suitably located bore in end 9 of rafters 8. Each secondary rafter 8 is supported at lower end 12 upon a steel channel header 60 (FIG. 4) or valley/hip rafter 20 (FIG. 4) the details of which are illustrated in FIG. 11 and as will be discussed below.

Figure 12:
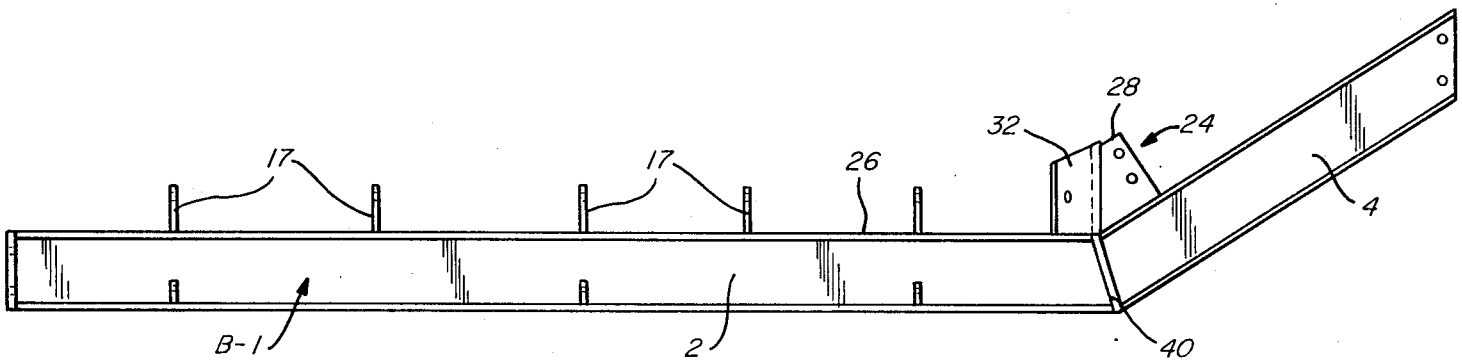
FIGS. 12 and 13 are elevation and plan views of a structural element which forms a portion of a frame constructed in accordance with the present invention.
Figure 13:
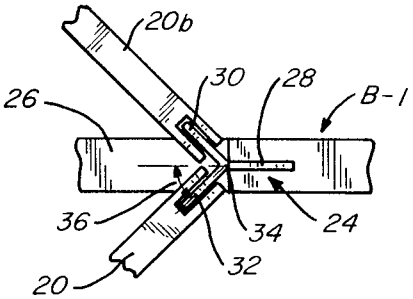

To complete the rafter assembly frame F further includes two valley rafters 20. For simplicity, only a single valley rafter 20 is illustrated in the drawings but it should be understood that the rafter assembly for gable G-2 includes a second valley rafter 20*b* depending from ridge beam B-1 in the same fashion as rafter 20 shown in FIG. 4. Rafters 20 and 20*b* are mounted to ridge beam B-1 via Y-shaped flange 24, the details of which are illustrated in FIGS. 12 and 13.

Flange 24 is an unitary, Y-shaped flange formed of structural steel plate, angle or similar material welded or otherwise made integral with the upper surface 26 of ridge beam B-1. Flange 24 includes a stiffner plate member 28, a first valley rafter mounting plate member 30 and a second valley rafter mounting member 32 (FIG. 13). Members 28, 30 and 32 are vertically oriented planar members joined along a common edge 34.

Stiffner plate 28 is formed to lie co-extensively with a portion of the longitudinal axis of sloping section 4 of ridge beam B-1, so as to provide a mounting for secondary rafters 8 when needed at this junction. Valley rafter mounting members 30 and 32 are joined to member 28 at an angle 36 with respect to the longitudinal axis of ridge beam B-1, angle 36 corresponding to the angle between the valley junction 38 formed between primary gable G-1 and secondary gable G-2 (FIG. 1) and the ridge 29 of secondary gable G-2. Flange 24 is formed at elbow 40 of ridge beam B-1 so that member 28 extends partially along sloping section 4 and members 28 and 30 extend partially along ridge section 2.

Figure 15:
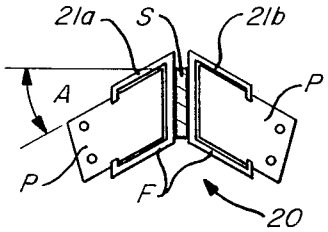
Figure 14:
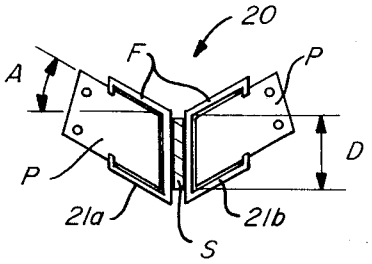

Referring now to FIGS. 14 and 15, valley (FIG. 14) and hip rafters 20 (FIG. 15) consist of cold formed steel channels 21*a* and 21*b* mounted back to back. Channels 21*a* and 21*b* are separated by steel spacer plates (S) which are attached to the channels at suitable intervals to form the basic rafter assembly. Spacer plates (S) are of sufficient thickness to allow column connection plates 70 (FIGS. 8 and 9) and ridge beam connection plates 30 and 32 (FIG. 13) to be received in the space between the channels 21 which form the hip or valley rafters 20. Flanges (F) are formed to the appropriate angle A to correspond to the adjacent roof plane. Rafter depth D corresponds with the depth of rafter 8 both measured vertically. Connection plates P are welded to the hip or valley rafters 20 at the appropriate angle and interval for connection of rafters 8 (FIGS. 14 and 15).

Figure 10:
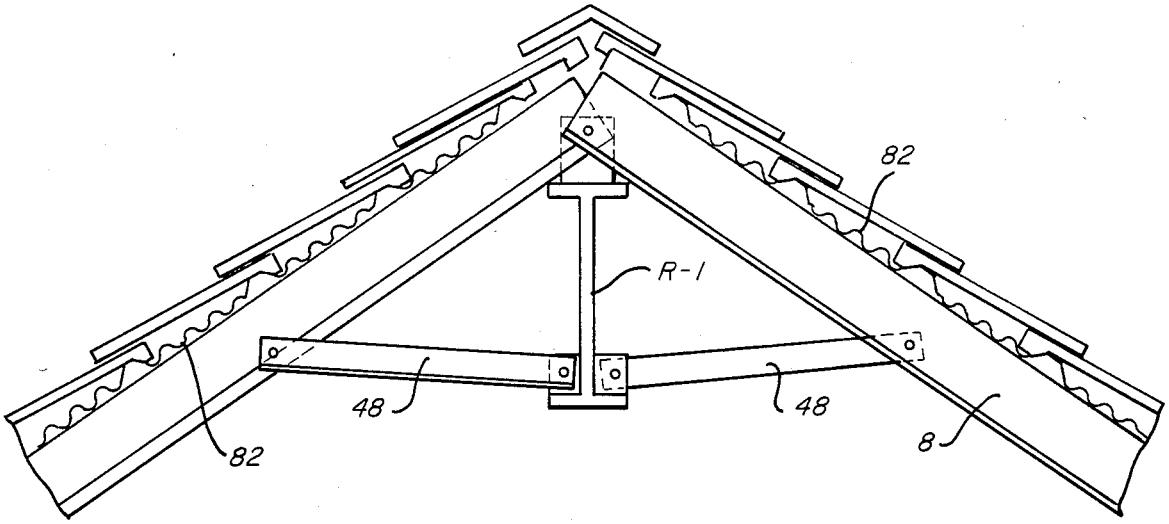
FIGS. 10 and 11 are cross sectional views at the ridge and eave lines showing the triangles forced by the various structural elements to provide lateral stability to the structure.

To provide structural rigidity, frame F also includes steel rafter braces 48 (FIG. 10) connected between secondary rafters 8 and primary rafter R-1, and ridge beam B-1 (FIG. 4) Further structural support is achieved by providing a similar rafter brace 54 connected between the lower end of each rafter 8 and steel channel header 60 (FIG. 11).

A support surface for roofing materials, such as shingles, tiles or the like, is formed from corrugated or ribbed metal panels 82 (FIGS. 10 and 11) mounted over rafters 8 using any suitable conventional mounting method such as screws or welding. Panels 82 are formed having uniformly spaced, parallel ribs or corrugations 84 which, when aligned with those of adjacent panels form continuous metal battens upon which shingles, tiles or other roofing members may be mounted.

At the lower extreme of secondary rafters 8 and valley or hip rafters 20, a continuous cold formed steel member 100 (FIG. 11) is attached to form the facia along the eave line of the structure. The facia 100 is so formed that the connection at the top 102 to rafters 8 and hip or valley rafters 20 and at the bottom 104 to brace 54 are concealed from view so as to provide a fully finished appearance. Further, flange 106 of the facia provides a horizontal surface for concealed attachment of soffit materials.

Figure 9B:
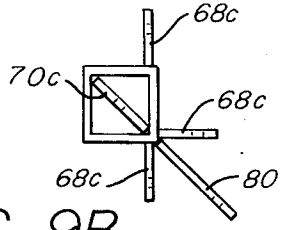
FIGS. 7–9 are elevation and plan views of different embodiments of structural members which form a portion of the present invention.
Figure 9A:
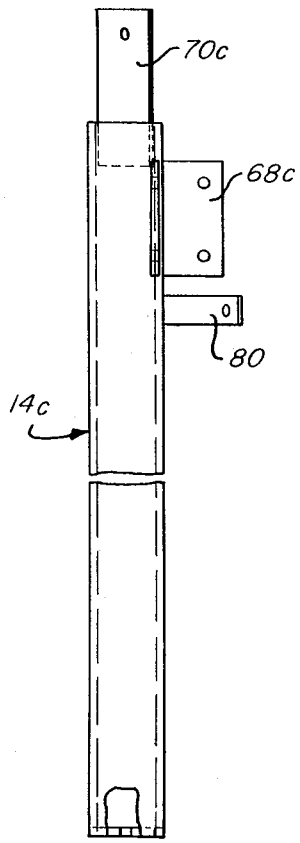
Figure 7B:
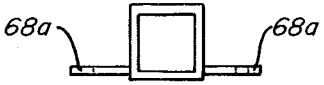
Figure 7A:
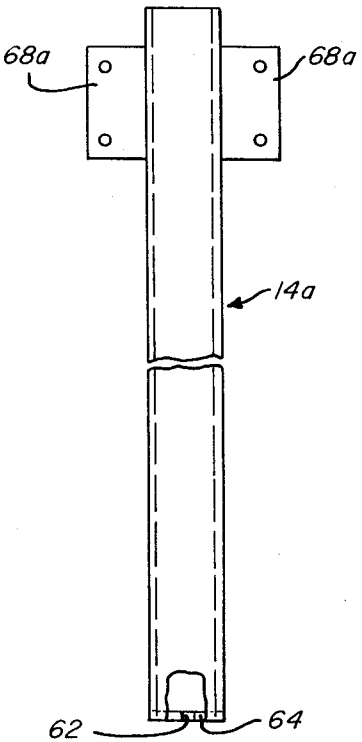

The exterior perimeter roof support structure for frame F is completed by providing a number of horizontal steel channel headers 60 which are connected to and span between adjacent vertical columns 14. The details of columns 14 are illustrated in FIGS. 7, 8 and 9.

Each of columns 14 comprises a tubular steel column having a square cross-section. Columns 14 are typically mounted to anchor bolts embedded in slab S at the time slab S is poured in the manner known in the art and hence not described herein. For the purposes of illustration, columns 14 include a bore 62 in base plate 64 adapted to receive an anchor bolt or the like.

Each column 14 is provided with header mounting flanges 68 in a configuration depending upon the exterior wall structure desired at the location of the particular column 14. Headers 60 are mounted to flanges 68 in any suitable, conventional manner such as bolt connections passing through a flange 68 and bores in header 60. For example, column 14*a*, illustrated in FIG. 7, is provided with two laterally extending header flanges 68*a* so as to be suitable for use at points along the exterior wall structure away from the corners (FIG. 4).

Figure 8B:
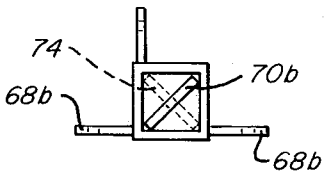
Figure 8A:
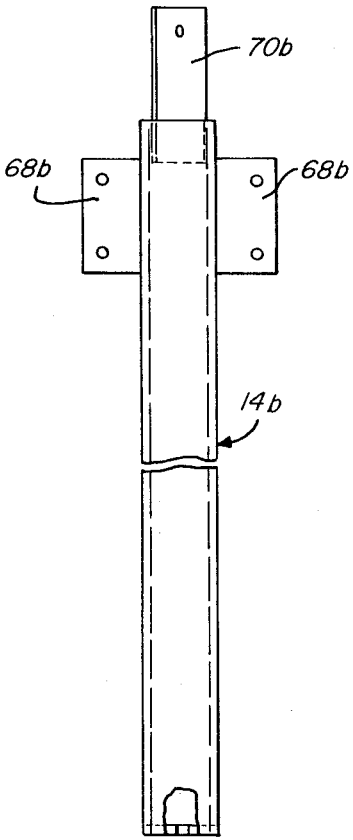

Referring now to FIG. 8, tubular column 14*b* is provided with lateral header flanges 68*b* adapted to provide a mounting for a header 60 to either side of column 14*b*, and an obliquely formed rafter flange 70*b* adapted to provide a parallel mounting for an oblique rafter, such as valley rafter 20 illustrated in FIG. 4. Although not illustrated in FIG. 4, a similar column 14*b* provides a mounting for the second valley rafter 20*b* decending from ridge beam B-1 to the opposite side of gable G-2. Column 14*b* at this location is identical to column 14*b* illustrated in FIG. 8 with the exception that flange 70*b* must be mounted within column 14b in the opposite angular orientation to accommodate the angle at which rafter 20b forms with the exterior wall. It should be understood that the configuration of flange 70b may be readily adapted from a left hand embodiment to a right hand embodiment as is needed for particular applications merely by mounting flange 70b across the alternate diagonal 74 of tubular column 14 in the manner shown in phantom in FIG. 8b.

By modifying the particular configuration of flanges 68 and 70 with respect to column 14, a structural support and mounting for the various rafter angles and header requirements can be easily fabricated. For example, a typical further modification designated 14c is illustrated in FIG. 9. Column 14c is provided with a third header flange 68c to thus provide a mounting for three orthogonal headers 60 to accommodate a particular structural variation. Column 14 may also be provided with additional wall support flanges such as flange 80 in FIG. 9 to connect rafter braces 54 at the building corners.

Thus, frame F provides a complete structural framework for constructing residences H having a primary gable G-1 and one or more secondary gables G-2 or hips V-1. The unique features of frame F permit a variety of roofing plans to be accommodated by utilizing one or more secondary gables G-2 or V-1 in combination with primary gable G-1 in modular fashion.

Figure 2:
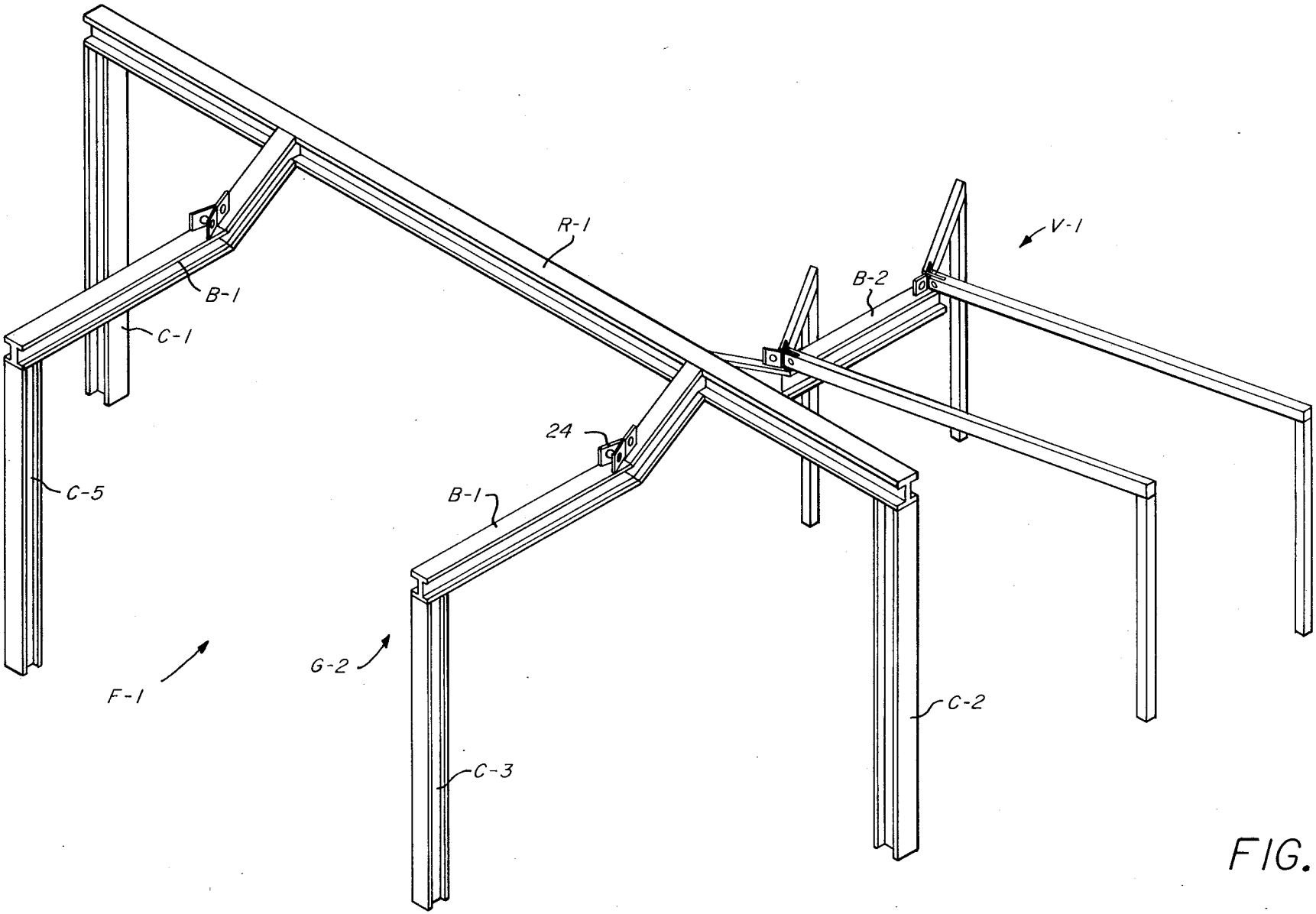
FIG. 2 is an isometric view of a portion of a steel frame for the residence illustrated in FIG. 1.
Figure 5:
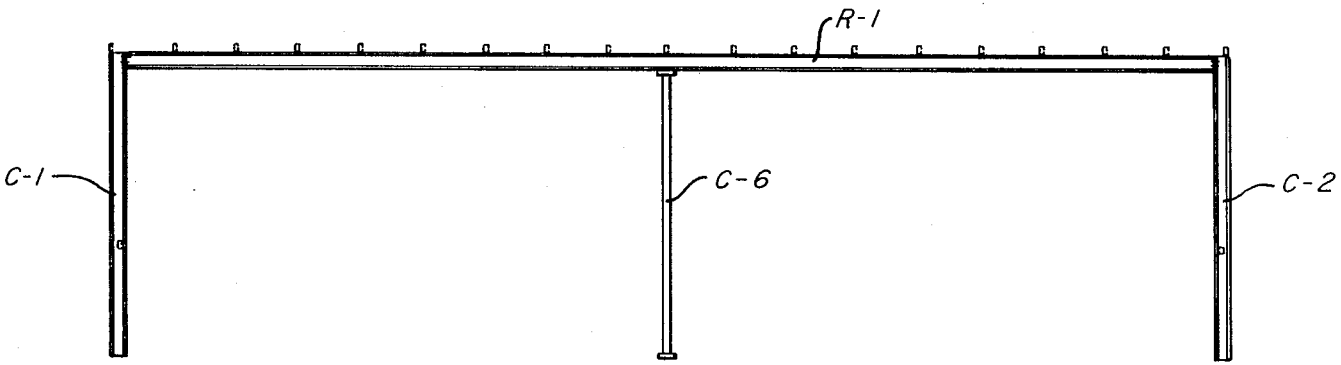
FIG. 5 is an elevation view of a portion of a steel frame constructed in accordance with the present invention.
Figure 6:
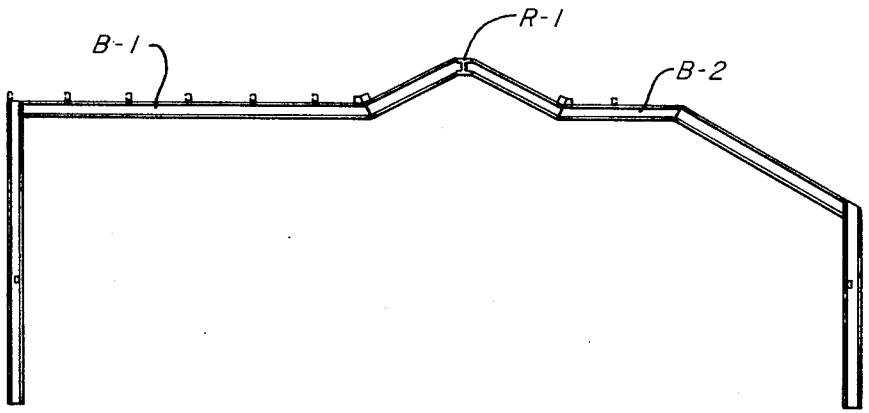
FIG. 6 is an elevation view of a frame for the residence of FIG. 1 constructed in accordance with the present invention.

For example, in FIG. 2, the basic frame F-1 for the residence H illustrated in FIG. 1 is formed using two secondary gables G-2 and one hip V-1, each constructed in the manner described above. Furthermore, it should be clear that the dimensions of secondary gables G-2 or hips V-1 may be varied by varying the dimensions of primary rafter R-1, or suitably modifying other structural members to form a structure of the desired dimension and angular configuration. For example, in the residence H (FIG. 1) it is desired that hip V-1 have a rearward extension less than the forward extension of secondary gable G-2. To accommodate this particular plan, hip V-1 is formed over secondary ridge beam B-2 (FIG. 6) which is shorter than secondary ridge beam B-1 but otherwise similar in structure. Where particularly long spanning primary ridge rafters R-1 are required, additional vertical load bearing columns C-6 (FIG. 5) may be readily provided.

The foregoing disclosure and description of the invention are illustrative and explanatory thereof and various changes in the size, shape and materials as well as in the details of the preferred embodiment may be made without departing from the spirit of the invention.

I claim:

1. A metal frame residence having a plurality of exterior walls joined together to form an enclosure and a support frame for a gabled or hipped roof therein formed from a plurality of metalized structural members, the roof being of the type having a primary gable or hip and a secondary gable or hip extending substantially perpendicular to the primary gable, said frame comprising:

a first vertical column;

a second vertical column:

a primary ridge rafter for providing support at the ridge of the primary gable, said primary rafter being adapted to span between said first vertical column and said second vertical column;

a plurality of secondary rafters surmounting said primary ridge rafter and adapted to span between said primary ridge rafter and an exterior wall of said residence to form a support for the roof, said secondary rafters being substantially parallel to one another and perpendicular to said primary ridge rafter;

a third vertical column;

a secondary ridge beam spanning between said third column and said primary ridge rafter for providing support at the ridge of the secondary gable, said secondary ridge beam being formed having a horizontally disposed ridge section adapted to form a support member underlying the ridge of the secondary gable, and a sloping section joined to said ridge section at an angle corresponding to the pitch of the primary gable, said sloping section being adapted to complete the transition from the lower secondary ridge line to the higher primary ridge line; and a plurality of secondary rafters surmounting said secondary ridge beam and adapted to span between said secondary ridge beam and an exterior wall of said residence to form a support frame for the roof, said secondary rafters being substantially parallel to one another and perpendicular to said secondary ridge beam.

2. The residence of claim 1 wherein said frame further comprises:

a valley rafter surmounting said secondary ridge beam and adapted to span between said secondary ridge beam and an exterior column to provide a support member underlying the valley junction between the primary gable and the secondary gable.

3. The residence of claim 2 wherein said frame further comprises:

a second valley rafter surmounting said secondary ridge beam at the junction of said ridge section and said hip section and adapted to span between said secondary ridge beam and an exterior column to provide a support member underlying a second valley junction between the primary gable and the secondary gable.

4. The residence of claim 2, wherein said frame further comprises:

a first plurality of junction rafters surmounting said secondary ridge beam and spanning between said secondary ridge beam and said valley or hip rafter; and a second plurality of junction rafters surmounting said primary ridge beam and spanning between said primary ridge beam and said valley or hip rafter.

5. The residence of claim 2 wherein said secondary ridge beam further comprises a rafter mounting flange formed on said secondary ridge beam overlaying the junction of said sloping section and said ridge section adapted for mounting said valley rafter to said secondary ridge beam pole.

6. The residence of claim 5, wherein said rafter mounting flange comprises:

a vertically oriented, substantially planar flange surmounting a portion of said sloping section of said secondary ridge beam and extending parallel thereto; and a vertically oriented, substantially planar valley rafter flange joined to said sloping rafter flange at an angle corresponding to the angle formed at the valley junction between the primary gable and the secondary gable.

7. The residence of claim 1, wherein said secondary ridge beam is formed having a plurality vertically oriented, substantially planar, rafter mounting flanges adapted for mounting said secondary rafters to said secondary ridge beam, said rafter mounting flanges surmounting said ridge section and being spaced uniformly along the length thereof, said rafter mounting flanges being formed in planes substantially perpendicular to the longitudinal axis of said secondary ridge beam pole.

8. The residence of claim 1, wherein said primary rafter is formed having a plurality of vertically oriented, substantially planar rafter mounting flanges for mounting said secondary rafters to said primary ridge rafter, said rafter flanges surmounting said primary rafter and being spaced uniformly along the length thereof, said rafter mounting flanges being formed in planes substantially perpendicular to the longitudinal axis of said primary ridge rafter.

9. The residence of claim 1, further comprising:

a first plurality of corrugated panel members overlaying said secondary rafters, said first plurality of panel members being arranged to form a substantially planar roofing support surface for application of roofing materials;

a second plurality of corrugated panel members overlaying said secondary rafters, said second plurality of panel members being arranged to form a substantially planar roofing support surface for application of roofing materials.

10. The residence of claim 9, wherein said panel members comprise uniform corrugated or ribbed planar members formed having a plurality of uniformly spaced parallel ridges, said panels being adapted for mounting to said secondary rafters so that said ridges on adjacent panel members align to form continuous roofing battens said battens being parallel to said primary rafter or said secondary ridge beam respectively.

11. The residence of claim 1 wherein said frame further comprises a plurality of horizontally disposed rafter braces, each of such rafter braces spanning between one of said secondary rafters and said primary or secondary ridge beam respectively.

12. The residence of claim 1 further comprising a support frame for a plurality of exterior vertical walls said frame being adapted to surmount a slab or similar horizontal support surface, said frame comprising:

a plurality of horizontally disposed headers;

a plurality of vertical column members having an upper end and lower end, said upper end being provided with a substantially planar, vertically oriented, rafter flange member adapted for mounting to hip or valley rafters, said upper end being further provided with a vertically oriented header mounting plate adapted to provide a mounting for one or more of said headers, said lower end being adapted for mounting to the slab; and wherein each of said headers spans between adjacent vertical column members to form a support frame.

* * * * *